United States Patent [19]

Knutson et al.

[11] 4,011,891

[45] Mar. 15, 1977

[54] PROPORTIONAL FLOW CONTROL VALVE

[75] Inventors: Dale A. Knutson, Oconomowoc; Kishor J. Patel, Hales Corners, both of Wis.

[73] Assignee: Applied Power Inc., Milwaukee, Wis.

[22] Filed: Aug. 6, 1975

[21] Appl. No.: 602,443

[52] U.S. Cl. ..... 137/625.62; 137/625.63; 137/625.64; 91/382

[51] Int. Cl.[2] ..... F15B 9/03

[58] Field of Search ..... 137/625.63, 625.64, 137/625.6, 625.62; 91/368, 464, 382, 374, 367

[56] References Cited

UNITED STATES PATENTS

| | | | |
|---|---|---|---|
| 2,582,088 | 1/1952 | Walthers | 91/464 X |
| 2,634,086 | 4/1953 | Johns | 91/464 X |
| 2,981,287 | 4/1961 | Caslow | 91/464 X |
| 3,434,390 | 3/1969 | Weiss | 137/625.64 |
| 3,736,958 | 6/1973 | Rostad | 137/625.66 X |
| 3,862,643 | 1/1975 | Dezelan | 137/625.63 |
| 3,875,849 | 4/1975 | Patel | 137/625.64 UX |

*Primary Examiner*—Alan Cohan
*Attorney, Agent, or Firm*—James E. Nilles

[57] ABSTRACT

A proportional flow control valve comprises a directional control valve having a valve spool, a servo actuator or servo means for operating said directional control valve, and manual override means for operating the valve spool. The servo means comprises a movable ram or piston for moving the valve spool to thereby operate the directional control valve and the ram has a pair of equally sized piston areas connected thereto. The servo actuator also comprises a pilot valve having a null position and is selectively operable to apply fluid alternately to either of said piston areas to effect ram and valve spool movement in one direction or another from a null position. Means including a proportional electromagnetic device such as a proportional solenoid or force motor are provided for selectively operating the pilot valve. Feedback means are connected between the ram and the pilot valve to maintain the ram and the valve spool in a position wherein they are moved. Orifice means are connected between the pilot valve and the piston areas for relieving fluid pressure on one piston area when fluid pressure is being applied to the other piston area. The orifice means also serve to relieve the fluid pressure on both piston areas whenever the signal to the proportional solenoid is zero and the pilot valve is in null position to thereby prevent ram movement. Biasing means are provided on the valve spool for maintaining the ram and the valve spool in null position whenever the proportional solenoid signal is zero. The biasing means exert a force on the valve spool which is less than the force exerted by fluid being applied to a ram area whenever an electric signal is applied to the proportional solenoid. The override means are manually operable to move the valve spool by means of a mechanical linkage to effect manual operation of the directional control valve.

4 Claims, 8 Drawing Figures

PROPORTIONAL FLOW CONTROL VALVE

BACKGROUND OF THE INVENTION

1. Field of Use

This invention relates generally to proportional flow control valves for operating double-acting cylinders, fluid motors and similar devices. In particular, it relates to proportional flow control valves comprising an electro-hydraulic proportional servo actuator or servo means for operating a directional control valve to control fluid flow to the cylinder or other aforementioned device.

2. Description of the Prior Art

The prior art discloses a wide variety of electro-hydraulic proportional servo actuator operated proportional flow control valves and U.S. Pat. Nos. 2,771,062 and 3,000,363 exemplify this. In some such prior art valves the servo actuator or servo means includes a pilot valve operable by a proportional solenoid or similar electro-magnetic device to effect axial movement of the valve spool of a directional control valve. Such prior art arrangements depend on the principle of applying continuous differential fluid pressures on pistons connected to the valve spool. Therefore, maintaining the control valve spool in null position depends upon precise control of differential pressures by the pilot valve over long periods of time. However, passages and orifices in the pilot valves are of relatively small diameter and can be easily partially clogged or blocked by fine unfiltered contaminants in the fluid. As a result, the partially blocked pilot valve orifices change the differential pressures acting on the piston areas and the control valve spool shifts from the null position thereby resulting in undesirable operation of the valve and the cylinder or other device being controlled. Filtering of the fluid is not an entirely satisfactory solution to this problem and contaminants and silt deposits can build up over a period of time, necessitating valve disassembly, cleaning or valve replacement.

SUMMARY OF THE INVENTION

A proportional flow control valve in accordance with the invention comprises a directional control valve including a valve spool; a servo actuator or servo means for operating said directional control valve; and manually operable override means for operating the directional control valve manually. The servo means comprises a ram or piston connected to the valve spool and movable in one direction or another from a null position to effect corresponding movement of the valve spool. The servo means further comprises first and second equally sized piston areas connected to the ram. A selectively operable pilot valve in the servo means comprises a movable servo sleeve and a movable servo spool which define first and second adjustable orifice means each having a null position and other selected positions for applying fluid pressure to the first and second piston areas, respectively, to move the ram and the valve spool in said one direction or another, respectively. The servo means is supplied with fluid at a relatively low pressure (on the order of 400 to 500 psi) which is independent of the pressure supplied to the directional control valve. Means such as an electrically operable proportional solenoid or similar electromagnetic device are provided for selectively operating the pilot valve by moving the servo spool. Feedback means in the servo means are connected between a sloped cam surface on the ram and a movable servo sleeve in the pilot valve to maintain the ram and the valve spool in a position to which they are moved. First fixed orifice means in the form of a hole in the servo spool in the servo means is connected in the hydraulic circuit between the first adjustable orifice means and the first piston area to relieve fluid pressure from the first piston area when fluid pressure is being applied to the second piston area. The first fixed orifice means also serves to divert fluid from the first piston area when the first adjustable orifice means is in the null position and thereby prevent movement of the ram and valve spool when the electric signal to the proportional solenoid is reduced to zero. Second fixed orifice means in the form of another hole in the servo spool in the servo means is connected in the hydraulic circuit between the second adjustable orifice means and the second piston area to relieve fluid pressure from the second piston area when fluid pressure is being applied to the first piston area. The second fixed orifice means also serves to divert fluid from the second piston area when the second adjustable orifice means is in the null position and thereby prevent movement of the ram and valve spool when the electric signal to the proportional solenoid is reduced to zero. Biasing means are connected to the directional control valve spool for maintaining the valve spool when the electrical signal is zero. The biasing means exert a force on the valve spool which is greater than the force exerted by fluid acting on the first and second piston areas when the electric signal is zero. Manually operable override means are connected to move the valve spool for effecting operation of said directional control valve. The override means act to move the valve spool against the bias of the biasing means and effect operation, through the feedback means, of the pilot valve to cause the latter to apply fluid pressure to one of the piston areas and thereby tend to create a force on the valve spool in a direction opposite that in which the valve spool is being moved by the manually operable override means. However, since the servo means is supplied with fluid at a relatively low pressure (on the order of 400 to 600 psi), the forces generated by the servo means in opposition to the manual override means can be overcome by manual input force levels.

A proportional flow control valve in accordance with the invention offers several advantages over prior art arrangements. For example, the centering spring on the valve spool ensures that the directional control valve spool remains in null position when the servo means or the override means are not being actuated. Furthermore, when there is no electrical signal to the proportional solenoid contaminant buildup in the pilot valve does not result in a movement of the valve spool since the fixed orifices divert fluid to tank when the adjustable orifices are in the null position. These fixed orifices also prevent valve spool movement unless differential pressure applied to the servo piston areas produces a force greater than that imposed by the preload of the centering spring. Should the adjustable orifices become clogged due to silting, the fluid pressures acting on the servo piston areas are even further reduced, as shown in FIG. 7, so that the biasing means becomes even more effective in maintaining the valve spool in the null position. Also, the centering spring, though acting positively on the valve spool to maintain null position, can easily be overridden in either direction by the manual override means. Other objects and advantages of the invention will hereinafter appear.

THE DRAWINGS

DESCRIPTION OF A PREFERRED EMBODIMENT

Figure 4:
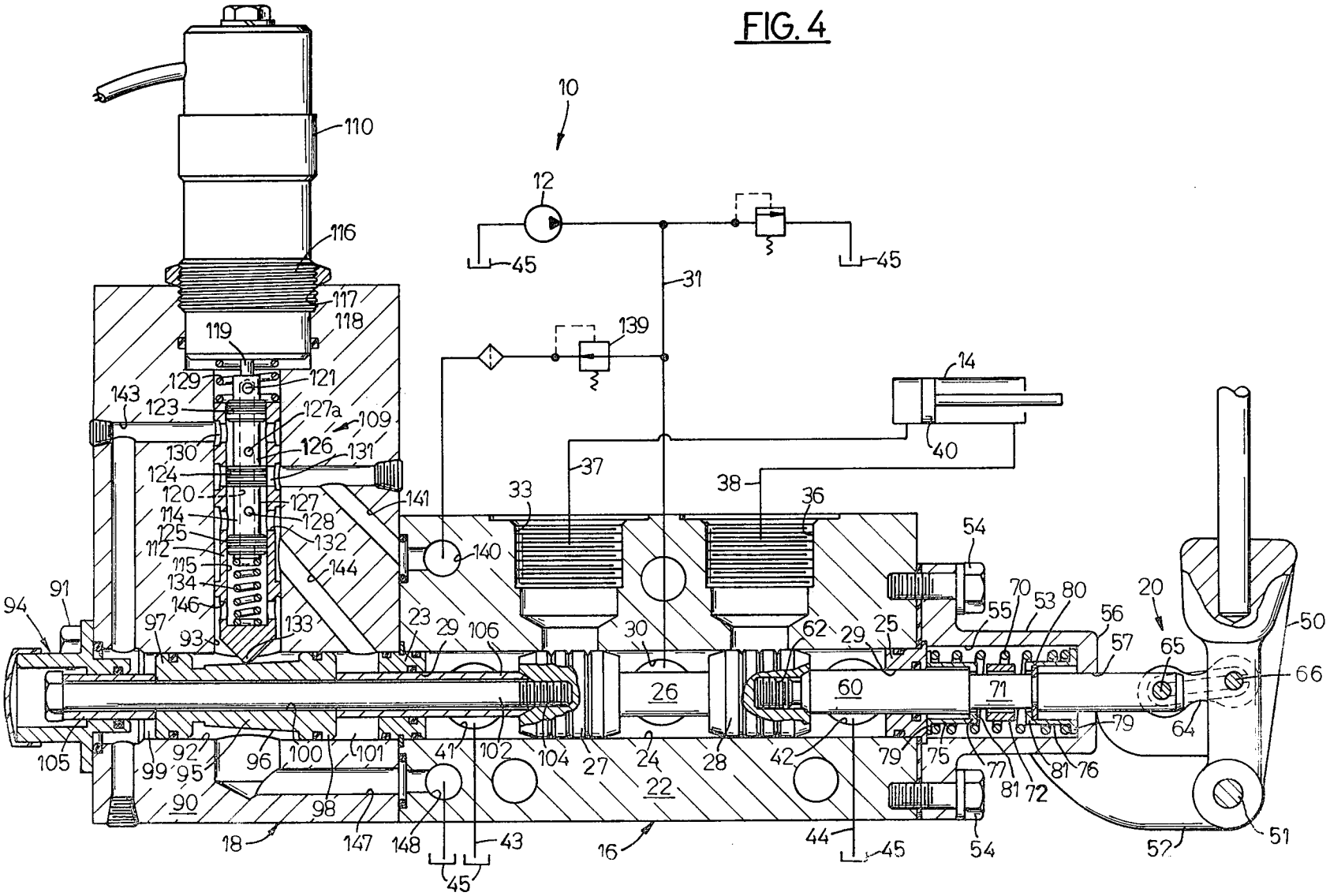
FIG. 4 is an enlarged, cross section view of the valve of FIG. 1 showing the valve in neutral fully closed null condition and combined with other system components.

Referring to FIGS. 1, 2, 3 and 4, the numeral 10 designates a proportional flow control valve in accordance with the present invention which, as FIG. 4 shows, controls fluid flow from a fixed displacement hydraulic pump 12 (drivable by means not shown) to a double acting hydraulic cylinder or actuator 14 to actuate or operate the latter to perform a function. Control valve 10 comprises a directional control valve 16, an electrohydraulic proportional servo actuator 18, and manually operable override means 20.

As FIG. 4 shows, directional control valve 16 comprises a valve housing 22 having a bore 24 therein in which axially slideable control valve spool 26 is located. The opposite ends of bore 24 are closed by bushing or glands 23 and 25, each of which has a central opening 29 therein. Spool 26 is provided with axially spaced apart pistons 27 and 28. Valve housing 22 comprises a fluid inlet port 30 connected by a fluid supply line 31 to pump 12; a pair of fluid outlet ports 33 and 36 connected by fluid lines 37 and 38, respectively, to cylinder 14 on opposite sides of piston 40 thereof; and a pair of fluid outlet ports 41 and 42 connected by a pair of fluid lines 43 and 44, respectively, to a reservoir or tank 45.

Figure 5:
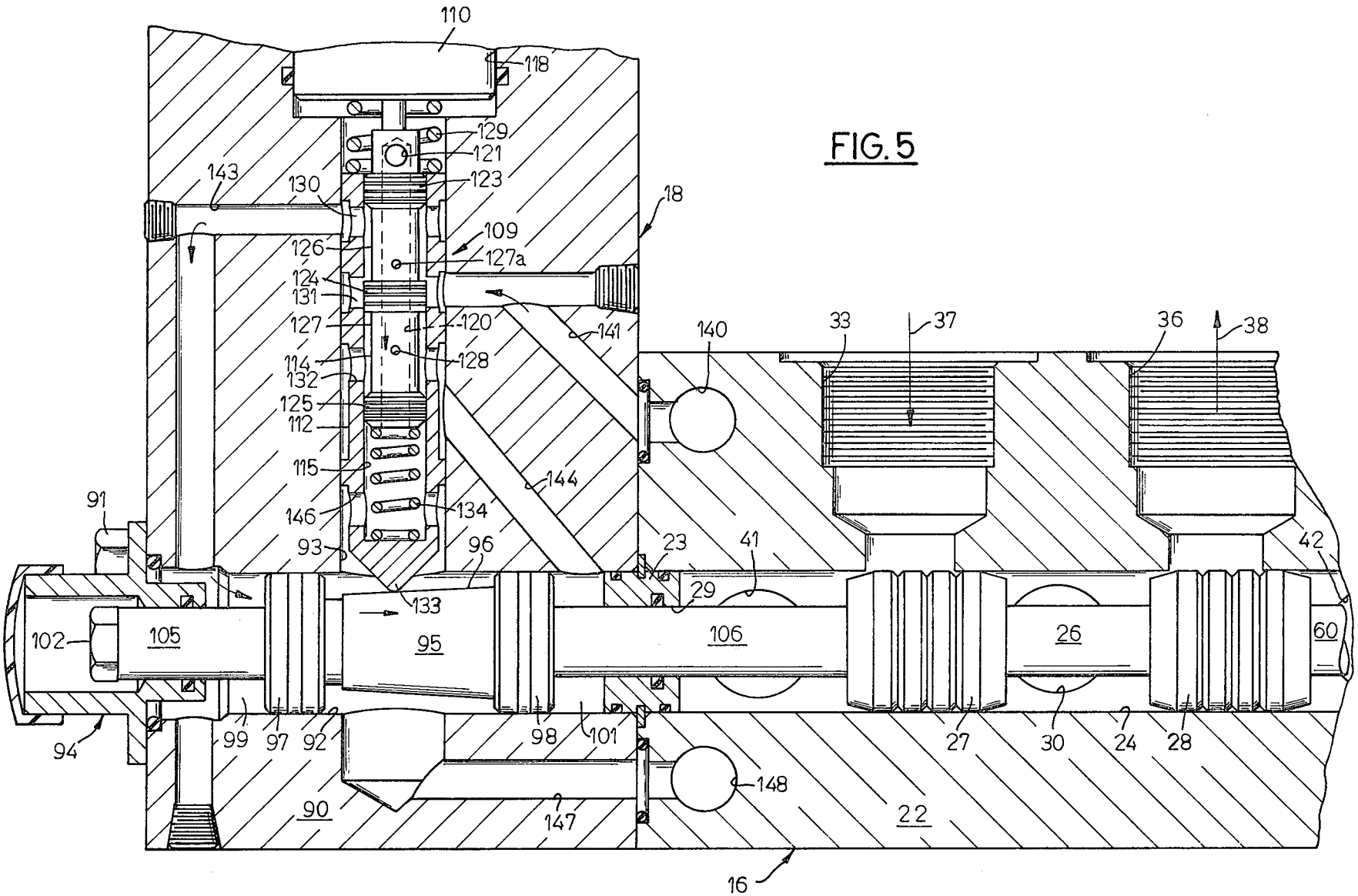
FIG. 5 is a further enlarged, cross section view of a portion of the valve shown in FIG. 4 and showing the directional control valve spool moved right to fully open position.
Figure 6:
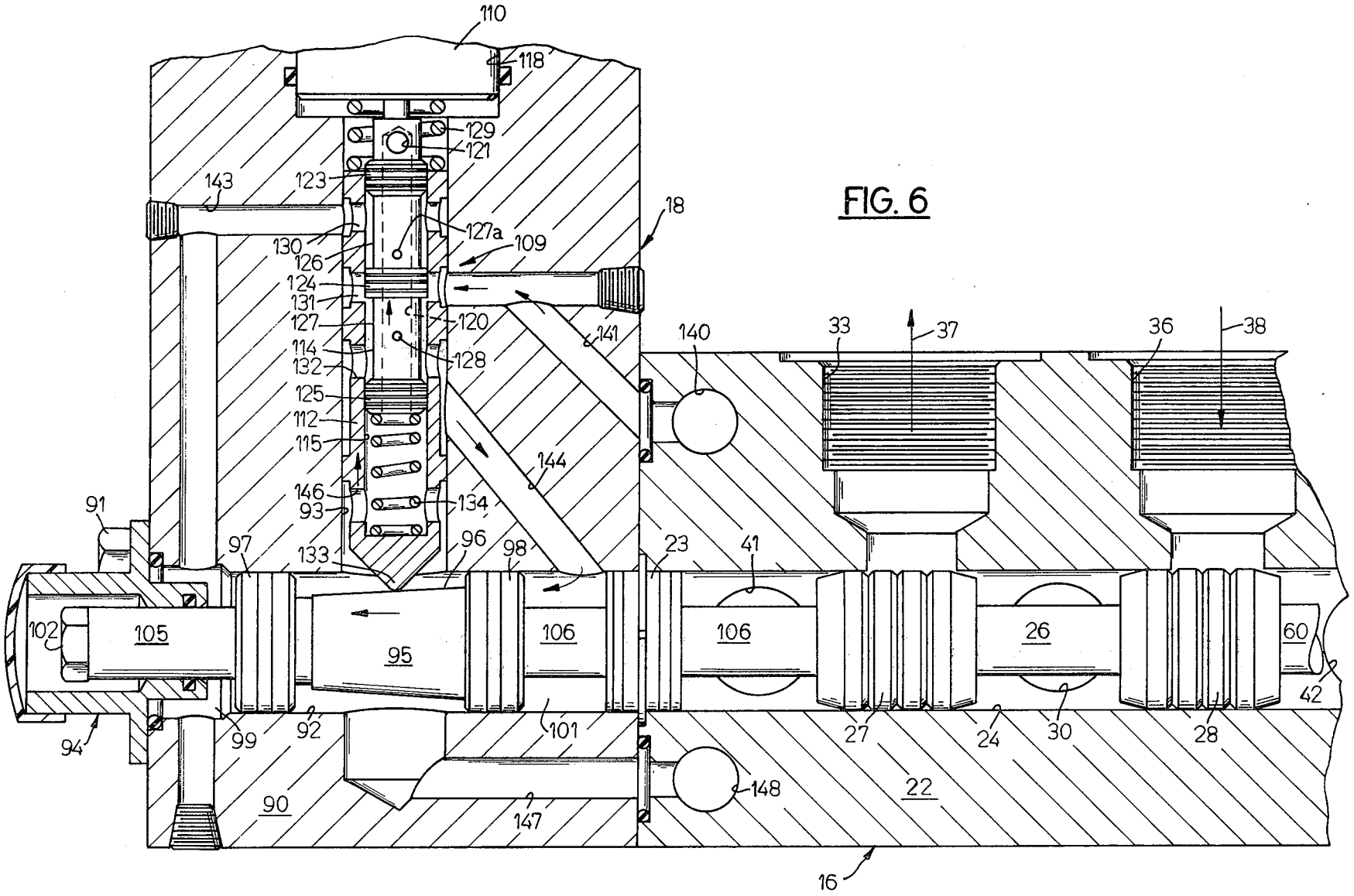
FIG. 6 is a view similar to FIG. 5 but showing the directional control valve spool moved left to fully open position.

FIG. 4 shows spool 26 of directional control valve 16 in null or neutral position wherein the outlet ports 33 and 36 are both closed, and the piston 40 of cylinder 14 is at rest. FIG. 5 shows spool 26 moved to the right wherein outlet port 36 is open to line 38 and port 33 is open to tank 45 thereby causing piston 40 of cylinder 14 to move leftward. FIG. 6 shows spool 26 moved to the left wherein outlet port 36 is open to tank 45 and port 33 is open to line 37 thereby causing piston 40 of cylinder 14 to move rightward.

FIGS. 1 through 4 show that the manual override means 20 comprises a manual operating lever 50 which is pivotally connected at its lower end by means of a pin 51 to a rigid projection or bracket 52 integrally formed on the exterior of a spring housing 53. Spring housing 53, which is rigidly secured to one end of valve housing 22 by means of bolts 54, has a chamber 55 therein and the end wall 56 of spring housing 53 has a central opening 57 therethrough. Opening 57 in spring housing 53 and opening 29 in gland 25 at the end of bore 24 of valve housing 22 accommodates a rod or stem 60 which extends therethrough and through chamber 55. The inner end of rod 60 is rigidly secured to the right end of valve spool 26 as by a threaded connection 62 and the outer end of rod 60 is connected by a link 64 and pins 65 and 66 to lever 50. Thus, pivotal movement of lever 50 effects direct corresponding axial movement of rod 60 and control valve spool 26 to enable direct manual or overriding operation of directional control valve 16.

As FIG. 4 show, means are provided in the chamber 55 of spring housing 53 to bias both control valve spool 26 and, as will hereinafter appear, a pilot valve in servo-actuator 18 into a null or neutral position. Such means comprises a compression type preloaded helical or coil spring 70 disposed in chamber 55 and surrounding rod 60. Rod 60 is provided within chamber 55 with a portion 71 of reduced diameter around which a hollow cylindrical stop collar 72 is disposed for limited sliding movement. Portion 71 provides or is defined by a shoulder 77 at one end and by a retaining ring 80 at its other end. A pair of hollow cylindrical spring caps 75 and 76 are provided on rod 60 and each comprises an outwardly extending flange 79 at its outermost end against which an end of spring 70 bears. Each spring cap 75, 76 further comprises an inwardly extending flange 81 at its innermost end which is adapted to engage the adjacent shoulder 77 formed at the end of the reduced diameter portion 71 of rod 60 or the retaining ring 80. This arrangement enables spring 70 to force the spring caps 75, 76 axially away from each other and against the end walls of chamber 55. The end caps 75, 76 in turn cause the rod 60 (and valve spool 26) to be maintained in a fixed null or neutral position, unless otherwise positively moved axially by the override means 20 or the servoactuator 18.

Figure 3:
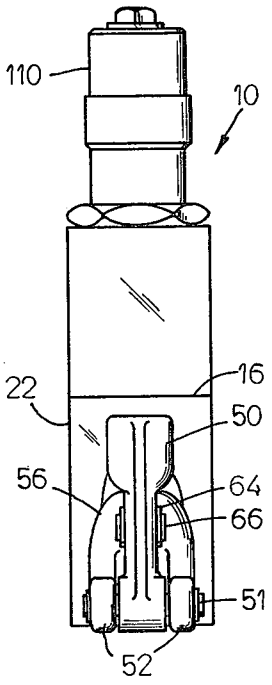
FIG. 3 is an end elevation view of the right end of the valve of FIG. 1.
Figure 1:
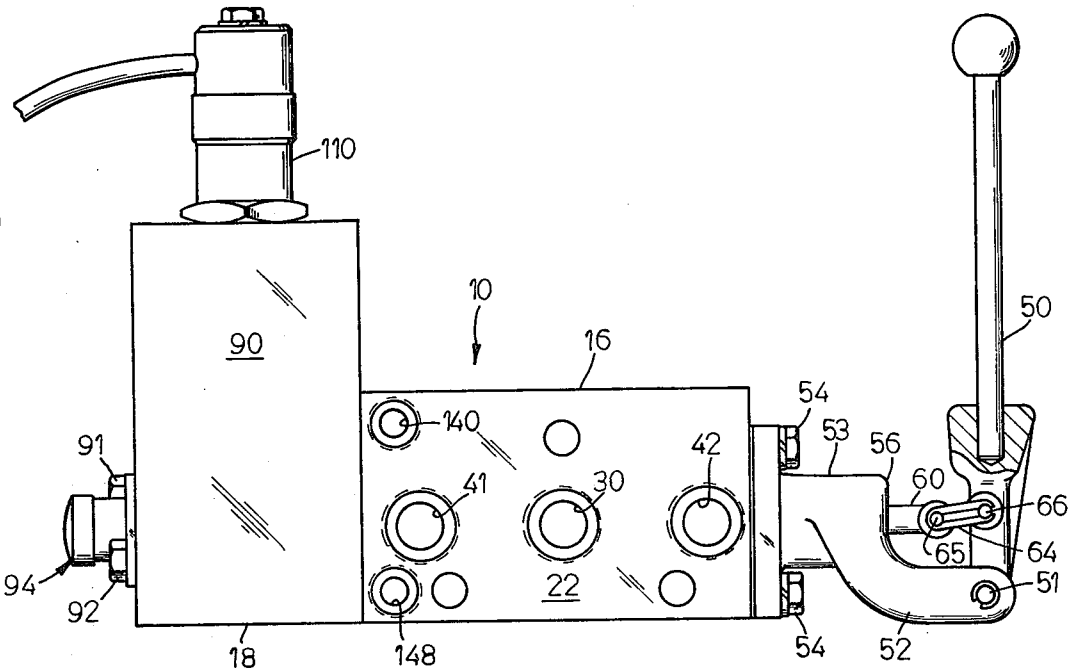
FIG. 1 is a side elevation view of a proportional flow control valve in accordance with the present invention.
Figure 2:
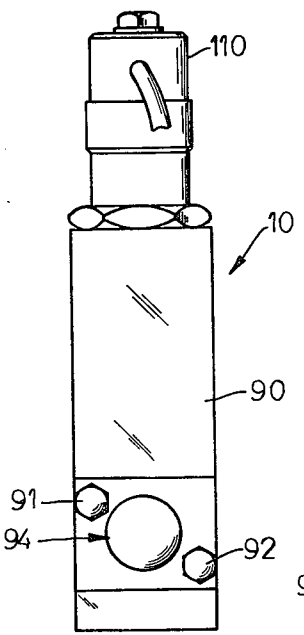
FIG. 2 is an end elevation view of the left end of the valve of FIG. 1.

As FIG. 4 shows, servo actuator 18 comprises an actuator housing 90 which is rigidly secured in sealed relationship to valve housing 22 by bolts 91 (shown in FIGS. 1 and 2). Actuator housing 90 has a bore 92 therein which is axially aligned with valve spool bore 24 in valve housing 22 but separated therefrom at one end by gland 23. The other or external end of bore 92 is closed and sealed by an end cap assembly 94. Actuator housing 90 is further provided with a bore 93 which intersects bore 92.

An axially slideable power ram 95 is disposed within actuator bore 92 and is provided with axially spaced apart pistons 97 and 98 at opposite ends thereof. The effective working areas of the pistons 97 and 98 are equal to each other. The pistons 97 and 98 cooperate with bore 92 to define ram extend and ram retract chambers 99 and 101, respectively. Ram 95 comprises a cylindrical cam surface 96 between the pistons 97 and 98. Ram 9b is provided with an axially extending central bore 100 therethrough for accommodating a long bolt 102 which extends therethrough (and through opening 29 in gland 23) and serves to rigidly secure ram 95 to an end of valve spool 26 by means of a threaded connection 104. Tubular spacers 105 and 106 surround bolt 102 to achieve proper spacing and engagement between ram 95 and valve spool 26 and to insure that the ram and valve spool move axially as a unit in either direction, whether motion is imparted by the ram or by the spool (in response to operation of override means 20).

Servo actuator 18 further comprises a four-way pilot valve 109 which is operable by a proportional solenoid 110 to control movement of ram 95 and the control valve spool 26 connected thereto. The four-way pilot valve 109 comprises a hollow outer servo sleeve 112 which is slideably mounted in bore 93 and a hollow inner servo spool 114 which is slideably mounted in a bore 115 in sleeve 112.

Solenoid 110 is cylindrical in form and has external threads 116 which engage complementary internal threads 117 in a mounting hole 118 in housing 90. Thus, solenoid 110 is adjustably rotatable to move it inwardly or outwardly so that its armature 119, which is axially movable forward (downward) or backward (upward) from a centered position, can be located at the null point. A solenoid such as 110 and an electrical control system therefor is described in U.S. Pat. No. 3,875,849 issued Apr. 8, 1975 and assigned to the same assignee as the present application.

Armature 119 of solenoid 110 bear against servo spool 114 but is not physically connected thereto. Servo spool 114 has a central passage 120 open at one end and three lands, 123, 124, and 125 on its exterior which define two grooves 126 and 127. One end of a servo spool biasing spring 134 bears against the lower end of spool 114 and the other end of spring 134 bears against the rear side of a cam follower member 133 which is integral with and movable with servo sleeve 112. Cam follower 133 bears against conical cam surface 96 on ram 95 being biased by spring 129.

Servo sleeve 112 has three annular grooves and ports 130, 131 and 132. Servo spool 114 has three metering lands 123, 124 and 125 and two annular grooves 126 and 127.

Pilot fluid at a pilot pressure P (on the order of 500 psi± 100 psi) is supplied from pump 12, through a reducing valve 139 to a port 140 in valve housing 22 and through a passage 141 to port 131 of servo sleeve 112.

When port 131 is opened by relative movement between servo spool 114 and servo sleeve 112 in response to operation of proportional solenoid 110, pilot fluid can flow either through groove 126 of servo spool 114 through port 130 of servo sleeve 112 and through a passage 143 in housing 90 to ram extend chamber 99 or through groove 127 to servo spool 114, through port 132 of servo sleeve 112 and through a passage 144 in housing 90 to ram retract chamber 101 depending on the direction of actuation of servo spool 114 by solenoid 110. Pilot fluid to the chambers 99 and 101 is at a pressure designated by Pc1 and Pc2, respectively, and such pressures are variable, depending on the extent to which the pilot valve is operated and are inversely related, i.e., as one increases the other decreases. Excess pilot fluid is able to return through the appropriate hole 121, 127*a* and 128 and the central passage 120 in servo spool 114, through a port 146 in servo sleeve 112, through a return or drain passage 147 connected to bore 92, to a return port 148 in valve housing 22 and from thence to tank 45; such fluid being at tank pressure.

It should be noted that the holes 127*a* and 128 in servo spool 114 are equal in size to each other and of such a size as to impose a fixed fluid resistance designated H1 and H2, respectively, on pilot fluid flowing therethrough to tank 45.

Figure 8:
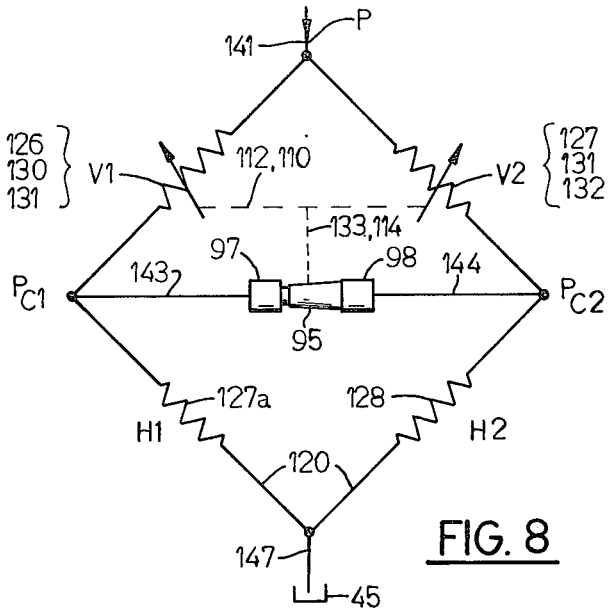
FIG. 8 is a schematic diagram symbolically showing the physical relationship of elements of a proportional flow control valve in accordance with the invention.
Figure 7:
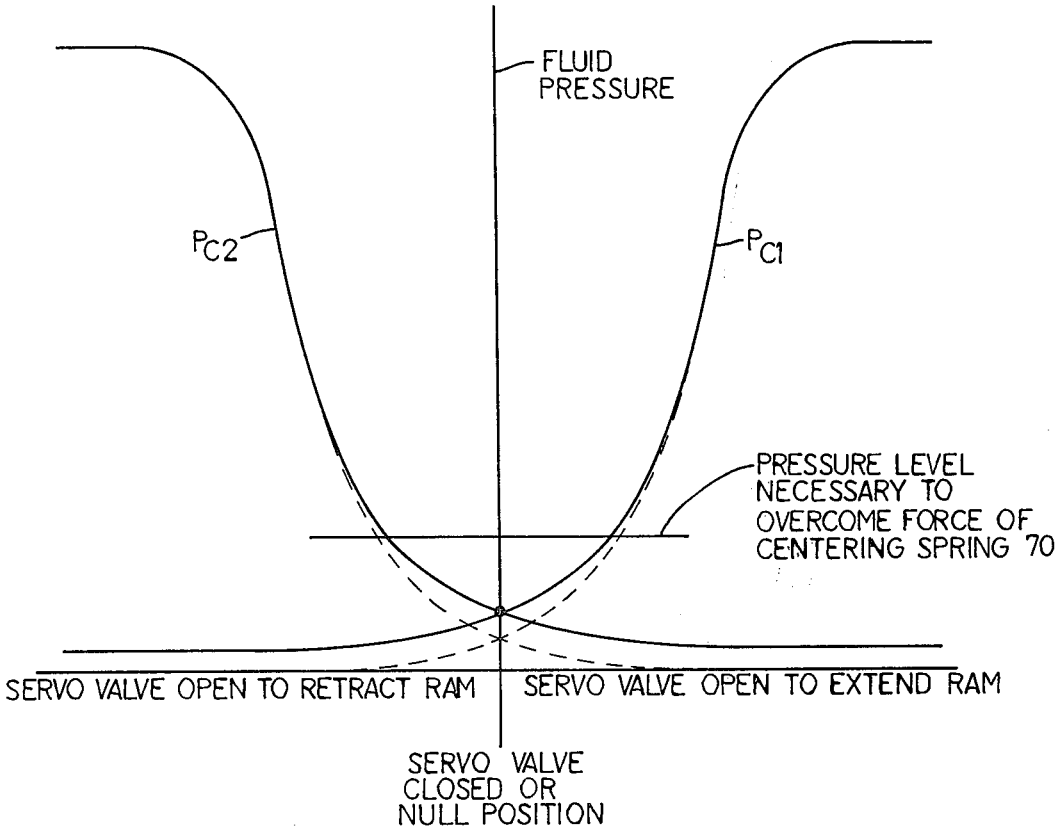
FIG. 7 is a graph depicting the fluid flow characteristic of a proportional flow control valve in accordance with the invention.

As the schematic diagram in FIG. 8 shows, the arrangement of components and passages in servo actuator 18 is such that they define a fluid flow network which provides a behavioral characteristic shown in FIG. 7. More specifically, refering to FIGS. 7 and 8, when valve 10 is in null position, the variable size orifice V1 defined by the opening 131, groove 126 and opening 130 and the variable size orifice V2 defined by opening 131, groove 127 and opening 132 are both normally closed. However, when either of these variable orifices V1 or V2 is opened to the desired degree, pilot fluid flows to the ram piston chamber 99 or 101, respectively, and expelled from the other ram piston chamber 99 or 101 is able to flow to tank 45 through the fixed orifice 127*a* or 128, respectively. As previously noted, however, movement of ram 95 is not effected unless or until fluid pressure acting against the pistons 97, 98 thereof exceeds the opposing force of centering spring 70 i.e., exceeds the pressure level designated PL in FIG. 7, for example. Accordingly, if there is pilot fluid leakage through orifice V1 or V2 or both (caused, for example, by contaminants in the pilot valve preventing their full closure), such leakage cannot effect ram movement or shifting of the ram 95 or valve spool 26 from null position, since such leakage is by-passed through the orifices 127*a* or 128 or both to tank 45.

Valve 10 operates in the following manner. Initially assure that all components are in the null position shown in FIG. 4 and that pump 12 is in operation.

To cause leftward movement of or positioning of piston 40 of cylinder 14, it is necessary to pressurize port 38 or directional control valve 16 and connect its port 37 to tank, as FIG. 5 shows. This is accomplished by energizing solenoid 110 to the desired extent to effect downward movement of its armature 119 and corresponding downward movement of servo valve spool 114, as shown in FIG. 5, to thereby open port 131 of servo sleeve 112. When port 131 is open, pilot fluid flows from passage 141, through port 131, through groove 126 in servo spool 114, through port 130 in servo sleeve 112, through passage 143 to ram extend chamber 99 thereby causing rightward movement of ram 95 and directional control valve spool 26. As fluid enters ram extend chamber 99, fluid is simultaneously expelled from ram retract chamber 101 to tank 45, being expelled through passage 144, port 132 in valve sleeve 112, groove 127 in valve spool 114, port 128 in valve spool 112, passage 120, port 146 in valve sleeve 112, bore 93 and passage 147. As shown schematically in FIG. 8, port 128 serves as a metering orifice to permit and regulate the rate of fluid flow from chamber 101. Therefore, ram 95 and spool 26 are not moved rightward until the fluid pressure in chamber 99 acting against piston 97 exceeds the biasing force of spring 70 which is acting in the opposite direction on the ram 95 and spool 26. When ram 95 and spool 26 commence rightward movement, cam follower 133 rides on sloped cam surface 96 of ram 95 and spring 129 causes downward movement of servo sleeve 112 thereby effecting reclosure of port 131 and cutting off fluid flow to chamber 99 thereby causing stoppage of movement of ram 95, of central valve spool 26. However, ports 33 and 36 of control valve 16 remain open and actuator piston 40 continues to retract at a rate determined by the extent to which the ports 33 and 36 are opened.

When solenoid 110 and pilot valve 109 are returned to null position, ram 95 and control valve spool 26 also return to null position and piston 40 of actuator 14 stops in whatever position it has been moved to.

During return of pilot valve 109 to null position and during operation of pilot valve 109 to cause rightward movement of piston 40 of actuator 14, the components of valve 10 initially assume the relative positions shown in FIG. 6.

To cause rightward movement or positioning of piston 40 of cylinder 14, it is necessary to pressurize port 33 of directional control valve 16 and connect its port 36 to tank, as FIG. 6 shows. This is accomplished by energizing solenoid 110 to the desired extent to effect upward movement of its armature 119 and corresponding upward movement of servo valve spool 114, as shown in FIG. 6, to thereby open port 131 of servo sleeve 112. When port 131 is open, pilot fluid flows from passage 141, through port 131, through groove 127 in servo spool 114, through port 132 in servo sleeve 112, through passage 144 to ram retract chamber 101 thereby causing leftward movement of ram 95 and directional control valve spool 26. As fluid enteres ram retract chamber 101, fluid is simultaneously expelled from ram chamber 99 to tank 45, being expelled through passage 143, port 130 in valve sleeve 112, groove 126 in valve spool 114, port **127*a* in valve spool 114, passage 120, port 146 in valve sleeve 112, bore 93 and passage 147. As shown schematically in FIG. 8, port 127a serves as a metering orifice to permit and regulate the rate of fluid flow from chamber 99. Therefore, ram 95 and spool 26 are not moved leftward until the fluid pressure in chamber 99 acting against piston 97 exceeds the biasing force of spring 70 which is acting in the opposite direction on the ram 95 and spool 26. When ram 95 and spool 26 commence leftward movement, cam follower 133 rides on sloped cam surface 96 of ram 95 and servo sleeve 112 is moved upwards against the action of spring 129 thereby effecting reclosure of port 131 and cutting off fluid flow to chamber 101 thereby causing stoppage of movement of ram 95 of control valve spool 26. However, ports 33 and 36 of control valve 16 remain open and actuator piston 40 continues to extend at a rate determined by the extent to which the ports 33 and 36 are opened. When solenoid 110 and pilot valve 109 are returned to null position, ram 95 and control valve spool 26 also return to null position and piston 40 of actuator 14** stops in whatever position it has been moved to.

If desired, valve 10 can be operated manually by means of lever 50 instead of by means of solenoid 10. Actuation of lever 50 in either direction causes direct corresponding movement of valve spool 26 and appropriate operation of piston 40 actuator 14. Manual movement of valve spool 26 also causes corresponding movement of ram 95 which, in turn, causes axial movement of servo valve sleeve 112. Such movement of servo valve sleeve 112 causes corresponding fluid flow from line 144 to either piston chamber 99 or 101, depending on the direction of actuation, and manual operation in one direction is thereby hydraulically checked by hydraulic forces on ram 95 tending to move the latter in the opposite direction, thereby insuring that a runaway condition does not arise.

We claim:

1. In a servo means:

a piston movable in one direction or another from a null position to perform a function;

first and second equally sized piston areas connected to said piston;

a selectively operable pilot valve comprising first and second adjustable orifice means each having a null position and other selective positions for applying fluid pressure to said first and second piston areas, respectively, to move said piston in said one direction or another, respectively, the extent of piston movement being proportional to the amount of fluid applied;

feedback means connected between said piston and said pilot valve to maintain said piston in a position to which it is moved;

first fixed orifice means connected between said first adjustable orifice means and said first piston area to relieve fluid pressure from said first piston area when fluid pressure is being applied to said second piston area, said first fixed orifice means also serving to divert fluid from said first piston area whenever the pilot valve is not activated and thereby preventing movement of said piston from the null position;

second fixed orifice means connected between said second adjustable orifice means and said second piston area to relieve fluid pressure from said second piston area when fluid pressure is being applied to said first piston area, said second fixed orifice means also serving to divert fluid from said second piston area whenever the pilot valve is not activated and thereby preventing movement of said piston from the null position, said first and second fixed orifice means being larger than said first and second adjustable orifice means in the null position, respectively; and biasing means acting on said piston for maintaining said piston in null position, said biasing means exerting a force on said piston which is greater than the force exerted by fluid when said pilot valve is not activated.

2. A servo means according to claim 1 including a proportional flow control valve connected to be operated by said piston of said servo means.

3. A servo means according to claim 1 including manually operable override means connected to move said piston for effecting performance of said function, said override means acting to move said piston against the bias of said biasing means.

4. A proportional flow control valve comprising:

a directional control valve including a valve spool;

a servo means for operating said directional control valve;

said servo means comprising a piston connected to said valve spool and movable in one direction or another from a null position;

said servo means further comprising first and second equally sized piston areas connected to said piston;

a selectively operable pilot valve in said servo means comprising first and second adjustable orifice means each having a null position and other selective positions for applying fluid pressure to said first and second piston areas, respectively, to move said valve spool in said one direction or another, respectively, the extent of piston movement being proportional to the amount of fluid applied;

means for selectively operating said pilot valve;

feedback means in said servo means connected between said valve spool and said pilot valve to maintain said valve spool in a position to which it is moved;

first fixed orifice means in said servo means connected between said first adjustable orifice means and said first piston area to relieve fluid pressure from said first piston area when fluid pressure is being applied to said second piston area, said first fixed orifice means also serving to divert fluid from said first piston area whenever the first adjustable orifice means is in the null position and thereby preventing movement of said valve spool from the null position;

second fixed orifice means in said servo actuator connected between said second adjustable orifice means and said second piston area to relieve fluid pressure from said second piston area when fluid pressure is being applied to said first piston area, said second fixed orifice means also serving to divert fluid from said second piston area whenever the second adjustable orifice means is in the null position and thereby preventing movement of said valve spool from the null position, said first and second fixed orifice means being larger than said first and second adjustable orifice means, position, respectively;

biasing means connected to said valve spool for maintaining said valve spool in null position, said biasing means exerting a preload force on said valve spool which is greater than the force exerted by fluid when said pilot valve is not activated; and manually operable override means connected to move said valve spool for effecting operation of said directional control valve, said override means acting to move said valve spool against the bias of said biasing means and further effecting movement of said piston.

* * * * *

UNITED STATES PATENT AND TRADEMARK OFFICE

CERTIFICATE OF CORRECTION

PATENT NO. : 4,011,891

DATED : March 15, 1977

INVENTOR(S) : Dale A. Knutson and Kishor J. Patel

It is certified that error appears in the above-identified patent and that said Letters Patent are hereby corrected as shown below:

| | | |
|---|---|---|
| Column 4 | line 59 | Change "cylindrical" to --conical-- |
| | line 60 | Change "9b" to --95-- |
| Column 5 | line 57 | Place a period after "operated" and delete "and are inversely" |
| | line 58 | Delete "related, i.e., as one increases the other decreases." |
| Column 6 | line 15 | After "and" insert --fluid-- |
| | line 35 | Change "or" to --of-- |
| Column 9 | line 13 | Change "actuator" to --means-- |

Signed and Sealed this

*Twenty-first* Day of *April 1981*

[SEAL]

*Attest:*

RENE D. TEGTMEYER

*Attesting Officer* *Acting Commissioner of Patents and Trademarks*